US005685243A

United States Patent [19]

Gohara et al.

[11] Patent Number: 5,685,243

[45] Date of Patent: Nov. 11, 1997

[54] APPARATUS FOR THE INJECTION DISTRIBUTION AND DISPERSION OF SORBENT IN A UTILITY BOILER FURNACE

[75] Inventors: Wadie F. Gohara, Barberton; Kevin J. Rogers, Wadsworth; Dennis K. McDonald, Massillon, all of Ohio

[73] Assignee: The Babcock & Wilcox Company, New Orleans, La.

[21] Appl. No.: 594,052

[22] Filed: Jan. 30, 1996

[51] Int. Cl.[6] ..... F23J 15/00

[52] U.S. Cl. ..... 110/345; 110/203; 110/204

[58] Field of Search ..... 110/203, 345, 110/204; 431/4

[56] References Cited

U.S. PATENT DOCUMENTS

| | | | |
|---|---|---|---|
| 4,381,718 | 5/1983 | Carver et al. | 110/347 |
| 4,655,148 | 4/1987 | Winship | 110/347 |
| 4,710,365 | 12/1987 | Gebhard et al. | 423/244 |
| 4,722,287 | 2/1988 | Anderson et al. | 110/263 |
| 5,020,456 | 6/1991 | Khinkis et al. | 110/345 |
| 5,047,221 | 9/1991 | Jozewicz et al. | 423/242 |
| 5,092,254 | 3/1992 | Kubin et al. | 110/233 |

*Primary Examiner*—Ira S. Lazarus
*Assistant Examiner*—Ljiljana V. Ciric
*Attorney, Agent, or Firm*—Daniel S. Kalka; Robert J. Edwards

[57] ABSTRACT

A system and method for distributing, injecting, and dispersing a sorbent mixture of sorbent and compressed filtered flue gas into the combustion furnace portion of a boiler furnace. Prior to injection into the combustion furnace, the sorbent mixture is heated with steam and distributed within the combustion furnace through a plurality of injection tubes having their ends arranged in a grid and oriented substantially toward the combustion furnace flue gas flow.

8 Claims, 3 Drawing Sheets

APPARATUS FOR THE INJECTION DISTRIBUTION AND DISPERSION OF SORBENT IN A UTILITY BOILER FURNACE

BACKGROUND OF THE INVENTION

1. Field of the Invention

The present invention relates generally to the field of utility and/or industrial boiler furnaces, and in particular, to a new and useful apparatus for delivering a sorbent to a furnace.

2. Description of the Related Art

Sorbent injection into boiler cavities is a proven technology for direct or indirect desulfurization of flue gas generated by coal-fired boilers. Furnace sorbent injection has developed during the past 20 years. The technology involves the pneumatic injection of limestone, dolomite or hydrated lime at a gas temperature of 2000° to 2300° F. (1093° to 1260° C.).

Sorbent injection, however, raises several issues with regard to delivery, distribution and dispersion into the furnace.

Delivery into the furnace has been achieved by injecting and dispersing pneumatically transported sorbent from nozzles which project through the furnace walls. Solids transport medium is required to carry the sorbent from a feeder bottle to the furnace in either dilute or dense phase. In addition to the solids transport medium, a large quantity of dispersion medium is necessary to insure the solids' penetration into the furnace cavity and uniform dispersion into the gas stream.

One known technique uses transport and injection air that is in addition to the combustion air required by the furnace. Since the additional injection air is at ambient temperature to start, this system requires a relatively small compressor and auxiliary power to bring the air to the required pressure. A problem with this technique is that it adds to the volume of gas in the boiler, requiring larger boiler enclosures in order to maintain conventional flue gas velocities. A system using this technique also suffers from decreased boiler efficiency, due to the excess air present during the combustion process.

A second known system used with staged combustion furnaces employs transport and injection air which is extracted from the boiler combustion air after the secondary air heater. This reduces the amount of air in the primary combustion zone.

The extracted air is then used for two purposes. First, to transport and inject the sorbent into the furnace at the secondary air injection point and second, to return the balance of the combustion air to the furnace.

Such a system is difficult to implement since the suitable temperature zone of the furnace for sorbent injection does not usually coincide with the optimum location for the secondary air injection to maintain acceptable $NO_x$ emission levels, especially at lower loads. This results in compromising either the temperature zone in which the sorbent is injected, which reduces sorbent utilization, or the secondary air injection location, which increases $NO_x$ formation and unburned carbon. Thus, this system limits the flexibility of the boiler operation and affects the furnace combustion efficiency. Often, a second set of injection ports are added to the furnace at the proper temperature zone for lower loads. Also, since the system uses preheated combustion air, which has a greater volume, it requires a larger compressor and more power to bring the transport and injection air to the proper pressure than the first technique described.

A third technique uses combustion air extracted after the secondary air heater which is not considered in the combustion staging process. This method has the same disadvantages as the first technique with the added increased power penalty of the second technique.

Mathematical modeling of the distribution and dispersion of sorbent is typically used to determine the locations of wall nozzles and their angle of wall penetration. These optimum conditions and locations are usually coincident at only one load, however, and as the boiler load changes and the gas flow patterns change, the sorbent dispersion becomes less optimum and mixing efficiency and the overall process efficiency decrease.

Also, this distribution system requires a larger cavity to allow dispersion and mixing of the sorbent and gas prior to the mixture reaching the convection pass heating surface, and as a result, the mixture temperature can drop dramatically. This is also because in these systems, the injected mixture of sorbent and air is at a temperature which is considerably lower than the furnace gas temperature at the point of injection. Injection of the cooler mass reduces the gas temperature, which in turn reduces the amount of heat available for steam generation. If the reduction is significant, this can increase convection pass heat transfer surface requirements.

In order to obtain good distribution of sorbent into the gas, the injection device needs to be able to deliver the sorbent to the desired location at as high a temperature as practical, while reducing or eliminating the use of air for transport or injection.

SUMMARY OF THE INVENTION

It is a primary object of the present invention to provide an improved injection, transport and distribution system for sorbent in a boiler furnace which overcomes many of the problems associated with other systems.

Accordingly, the present invention uses the flue gas which has been filtered by a particulate removal system, such as a baghouse or electrostatic precipitator (ESP) for the sorbent transport and injection medium. The flue gas is extracted from the flue after the particulate removal system, compressed to the required pressure(s), and conveyed through piping to a mixture point. At the mixture point, sorbent is added to the compressed flue gas, and the combined materials mix and travel through a single transport line until reaching one or more distribution bottles. The distribution bottles are arranged on both sides of the boiler furnace at the same elevation as a plurality of injection points. A number of injection tubes equal to the number of injection points carry the sorbent and flue gas mixture through the furnace wall to each of the injection points. The injection points are arranged in a grid dense enough to assure even dispersion of sorbent into the furnace. Each injection tube ending at an injection point is oriented toward the furnace flue gas stream with nozzles, distribution plates or radial distributors which are made from erosion resistant materials.

The amount of sorbent added to the mixture can be metered using a Ca/S demand signal to control a lock hopper used to isolate the low pressure sorbent storage section from the high pressure transport lines. Different solids feed devices may also be used to provide the sorbent stored at atmospheric pressure to the higher pressure transport lines.

Prior to injection into the boiler furnace, the solids and/or conveying gas may be heated by passing them through heat transfer surfaces located appropriately within the boiler system and/or by using steam-heated injection tubes.

Steam-heated tubes used for injection employ steam from an available source to heat the sorbent and clean flue gas mixture to approximately 900° F. (482° C.) prior to its injection into the furnace. The cleaned flue gas temperature is already elevated relative to ambient, and so less thermal energy is required to raise the temperature to an appropriate level for injection into the furnace, and it is a more efficient use of the boiler furnace and its gas by-product. Steam-heated tubes also control the mixture temperature to prevent dead burning of the limestone.

Another advantage is the clean, cool flue gas (usually at 250° F. or less) requires less power to compress than air taken from the combustion process after secondary air heating (usually at 500° F. or more). This results in reduced auxiliary power required.

A further advantage of the present invention is that the cleaned flue gas is free of particulate matter which keeps the compressor from eroding or becoming clogged.

A further advantage of the distribution system for injecting the sorbent mixture into the furnace is that because it is injected against the furnace gas flow direction, it reduces the need for a dispersion gas consequently, this reduces the added volume of gas in the convection pass and minimizes the necessary increase in convection pass area.

Another advantage is that because the conveying gas is recirculated, it does not impose any added flow requirements to the forced draft (FD) and induced draft (ID) fans as do techniques that use combustion air. Thus, another reduction in auxiliary power is realized.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
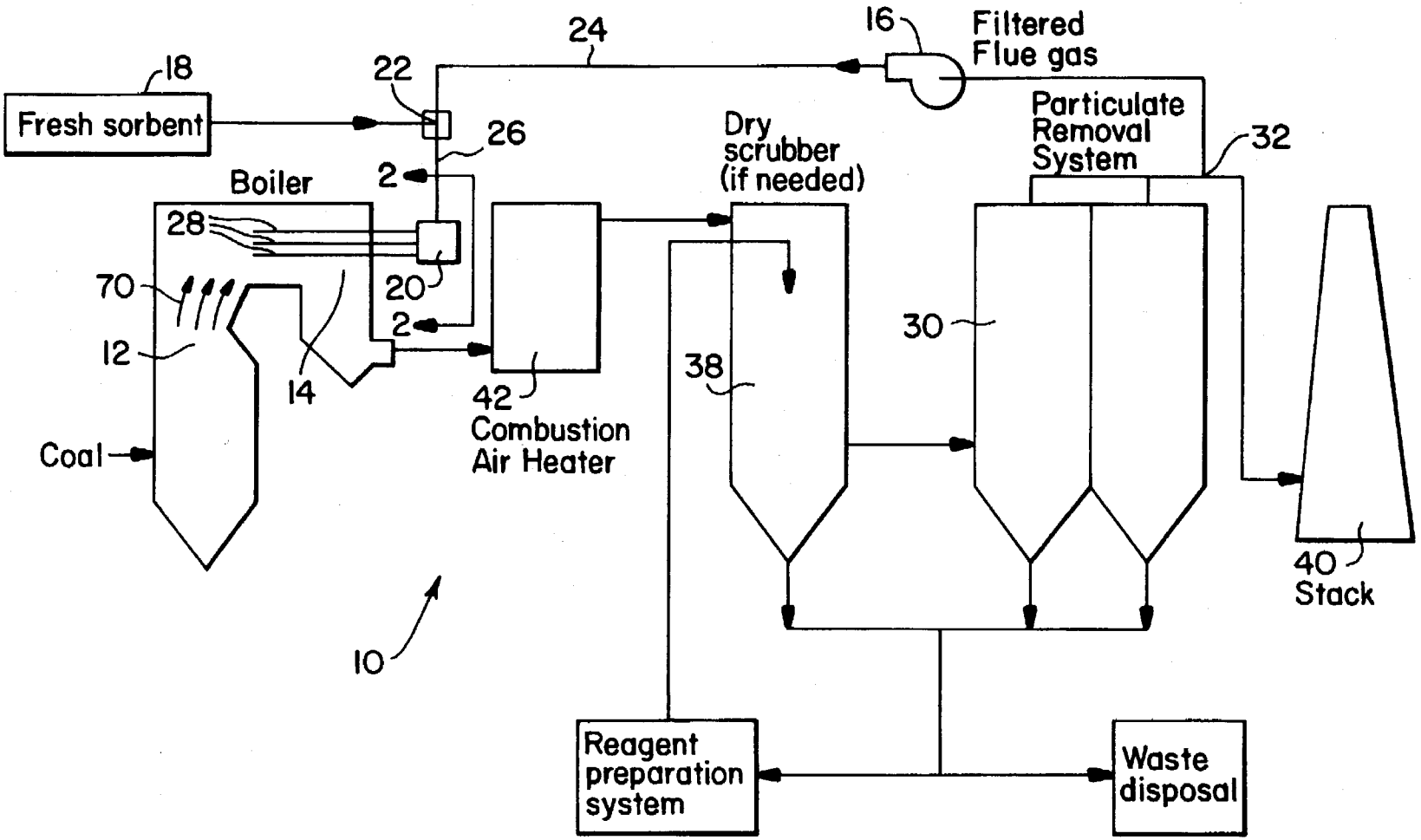
FIG. 1 is a schematic view of the injection system of the present invention.

Turning now to the drawings, FIG. 1 shows a boiler furnace system, generally designated 10, having a combustion furnace 12 which burns fossil fuels, and emits hot flue gases 70 into attached boiler 14. Boiler 14 contains heat exchanging tubes (not shown) containing water which is heated to steam by hot flue gases 70. In a conventional boiler furnace, flue gases 70 are subsequently passed through a heat exchanger 42 to remove more heat energy, a dry scrubber 38 if needed, and a particulate removal system 30 to remove solids before being passed to a stack 40 for release into the atmosphere.

In the system 10 of the present invention, some filtered flue gases are diverted after the particulate removal system from being emitted out the stack 40, at an extraction point 32. The filtered flue gases which are diverted from the outlet of the particulate removal system 30 are compressed to a higher pressure by a compressor 16. The compressed flue gases pass through a transport line 24 to mixture point 22. At mixture point 22, sorbent from atmospheric storage 18 is combined at the same pressure as the compressed flue gases using known means, such as a lock hopper, which isolates the higher pressure section from the lower pressure section, or a solid feed device.

The combined sorbent and compressed, filtered flue gas are conveyed through transport line 26, where they continue to mix, and then to distribution bottle 20. Only a single transport line is necessary until the sorbent mixture reaches one or more bottles 20. At this point, the mixture can be provided to one or more distribution bottles oriented around the boiler 14.

From the bottle 20, a plurality of injection tubes 28 carry the sorbent mixture through the furnace walls 34 (shown in FIG. 2) into the furnace. The sorbent mixture is heated within boiler 14 to approximately 900° F. before being distributed at a plurality of injection points 36, within the furnace 12 in a direction opposite the flow of hot flue gas 70.

Figure 2:
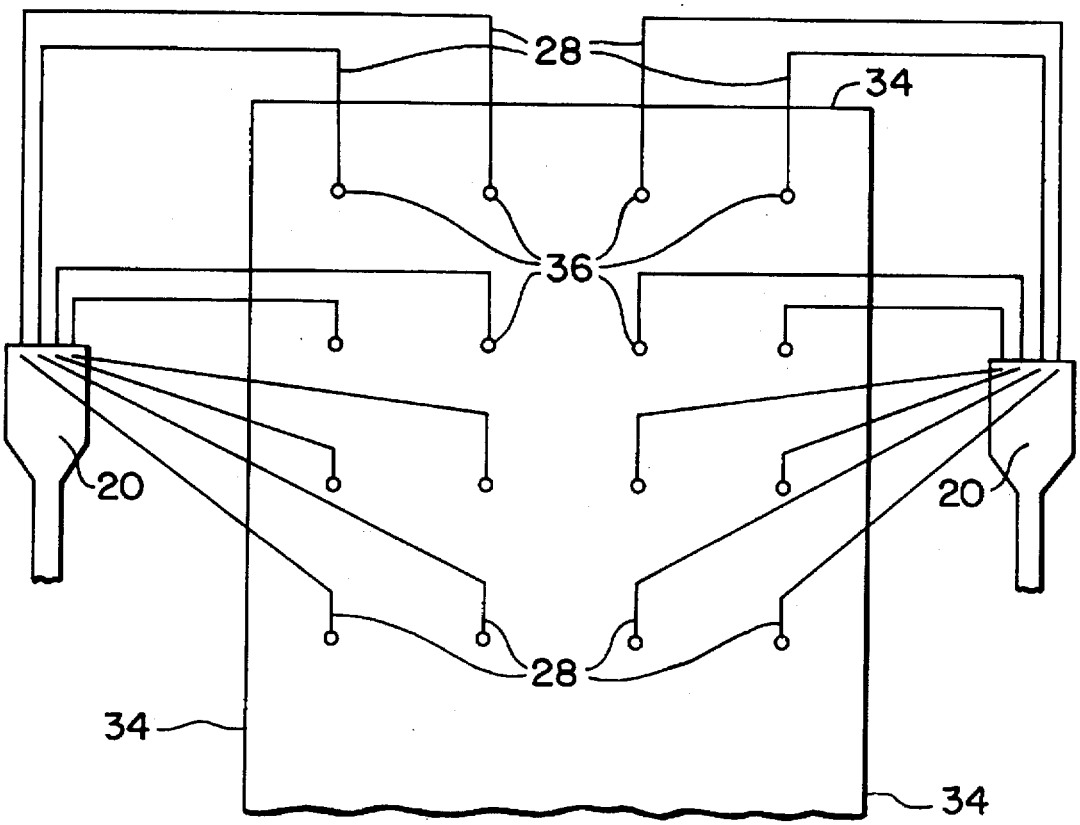
FIG. 2 is a schematic sectional view of the distribution grid of the present invention.

As seen in FIG. 2, the injection points 36 are arranged in a grid pattern designed to efficiently distribute the sorbent in the greatest area possible within the furnace walls 34 and provide a thorough mixing with the hot flue gases 70 (not shown in FIG. 2). One embodiment for the location of the distribution bottles 20 is shown, in which the bottles 20 are on each side of the furnace 12 and boiler 14 outside furnace walls 34. The bottles 20 could be located at approximately the same height as the injection points 36 or at any location where adequate space is available. The sorbent mixture is provided to each of bottles 20 through inlet 21 at its lower end. The bottles 20 each have a plurality of injection tubes 28 each leading to an injection point 36, which corresponds to the outlet end of each tube 28. The injection points 36 are coplanar and all are oriented toward the flow of hot flue gas 70 as seen in FIG. 1.

Figure 3:
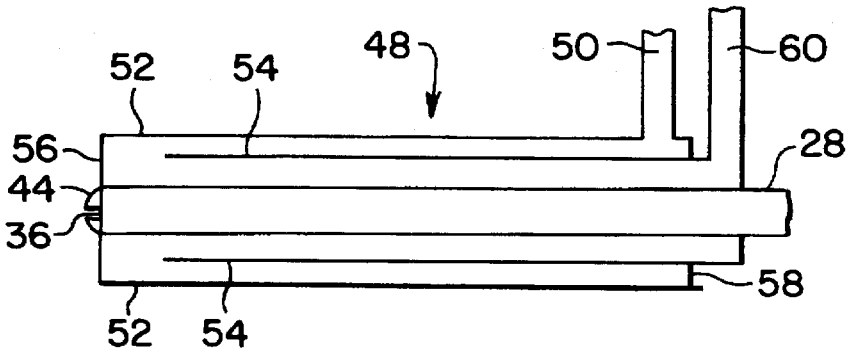
FIG. 3 is a sectional view of an injection tube of the present invention.

FIG. 3 shows a steam heated section 48 of an injection tube 28. In this embodiment, injection tube 28 is surrounded by inner sheath 54, which is open on one end and sealed closed against injection tube 28 on the other. Inner sheath 54 also has steam outlet 60 attached at an opening adjacent the sealed end. An outer sheath 52 surrounds both injection tube 28 and inner sheath 54 and has end cap 56 airtightly sealing the end of the sheath around injection tube 28 at injection point end 36. Steam inlet 50 is provided at the other end of outer sheath 52. A gap is left between end cap 56 and inner sheath 54, so that steam may pass from steam inlet 50, between outer sheath 52 and inner sheath 54 and through the gap to between inner sheath 54 and injection tube 28 to steam outlet 60.

Figure 4:
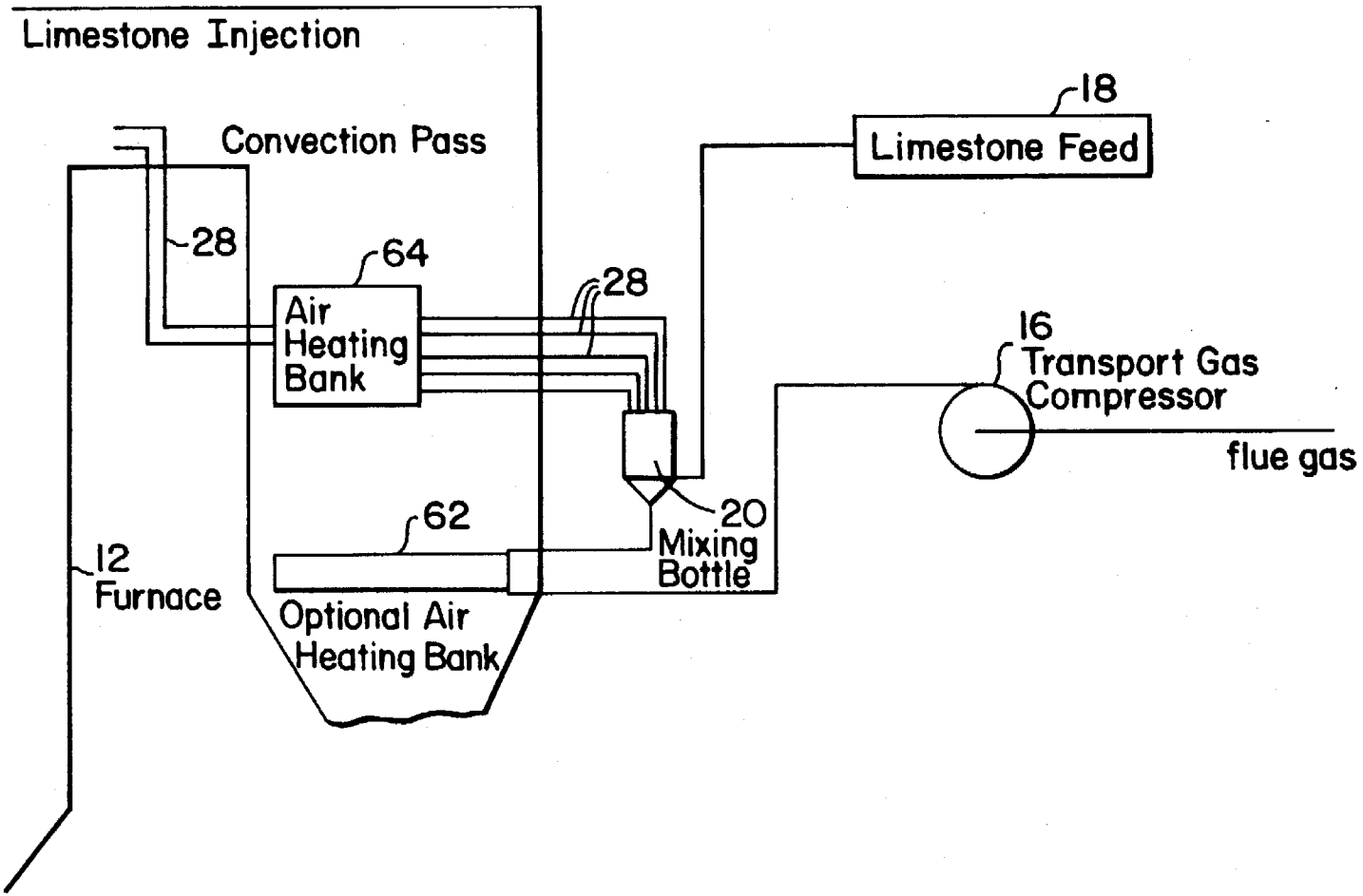
FIG. 4 is a schematic of an air heating bank embodiment.

FIG. 4 shows yet another embodiment of the present invention employing an optional air heating bank 62 which heats the transport gas by passing it through the lower convection pass of the furnace. The air heating bank 64 heats both the medium and the solids as the medium and solids are passed through this air heater bank which is also located in the lower convection pass.

Injection tube 28 can have one of several known types of distributors at its end 36, such as a nozzle 44, distribution plate or radial distributor. In each case, the distributor is made of an erosion resistant material.

While hot steam is in contact with injection tube 28, the sorbent mixture within the tube is heated to a temperature close to the furnace temperature. Since filtered flue gas is used to convey the sorbent to the furnace and is at an elevated temperature relative to ambient, the steam does not lose as much heat energy as it would if it were used to heat ambient temperature air.

While a specific embodiment of the invention has been shown and described in detail to illustrate the application of the principles of the invention, it will be understood that the invention may be embodied otherwise without departing from such principles.

What is claimed is:

1. An apparatus for injecting and distributing a sorbent into a flue gas flow in a furnace, comprising:

conveying means for transporting a filtered flue gas from the furnace;

a compressor having an inlet connected to the conveying means for receiving the filtered flue gas and an outlet for providing the filtered flue gas at a higher pressure;

a hopper containing the sorbent, the hopper being connected to the outlet of the compressor for supplying sorbent to the filtered flue gas;

mixing means connected to the hopper and to the outlet of the compressor for mixing the sorbent from the hopper with the filtered flue gas from the outlet of the compressor for creating a sorbent mixture;

a plurality of injection tubes, each tube having an open end, said tubes protruding through a furnace wall of the furnace, and arranged parallel to each other in a grid pattern, each open end being located at substantially the same horizontal distance from said furnace wall and oriented in the furnace flue gas flow, the plurality of injection tubes having heating means for heating each injection tube with steam; and distribution means connected to the mixing means and the plurality of injection tubes for receiving the sorbent mixture from the mixing means and for providing the sorbent mixture to the plurality of injection tubes.

2. The apparatus as recited in claim 1, wherein the heating means comprises:

an inner annular sheath surrounding each injection tube for defining a first annular gap therebetween, the inner annular sheath having a first end air tightly sealed to each injection tube end between said furnace wall and the injection tube open end;

a steam outlet connected to the inner annular sheath for allowing steam to exit the first annular gap, the steam outlet being adjacent the inner annular sheath first end;

an outer annular sheath surrounding the inner annular sheath and the injection tube for defining a second annular gap between the outer and inner annular sheaths, the outer annular sheath having first and second ends, the first end being adjacent the steam outlet and forming an air tight seal with the inner annular sheath;

an annular end cap fastened to the second end of the outer annular sheath and air tightly sealing the second end of the outer annular sheath to an injection point end of each injection tube; and a steam inlet connected to an opening on the outer annular sheath adjacent the air tight seal for allowing steam to enter the second and first annular gaps.

3. The apparatus as recited in claim 1, wherein the distribution means comprises at least one distribution bottle having a plurality of injection tube connections for attaching to each of the plurality of injection tubes.

4. The apparatus as recited in claim 3, wherein the mixing means comprises:

a transport tube having an opening located between a pair of ends, one end being connected to the output of the compressor, and the other end connected to at least one distribution bottle; and a lock hopper connected to the transport tube around the opening.

5. The apparatus as recited in claim 3, wherein the mixing means comprises:

a transport tube having an opening located between a pair of ends, one end being connected to the output of the compressor, and the other end connected to at least one distribution bottle; and a solids feed pump connected between the hopper and the transport tube.

6. The apparatus as recited in claim 3, wherein each of the open ends of the injection tubes further comprises a nozzle.

7. A method for injecting and distributing a sorbent into a flue gas flow in a furnace, comprising the steps of:

conveying flue gas from the furnace;

filtering the flue gas to form filtered flue gas;

conveying the filtered furnace flue gas from the furnace to a compressor:

compressing some of the filtered flue gas to form compressed filtered flue gas;

mixing a sorbent with the compressed filtered flue gas to form a sorbent mixture;

distributing the sorbent mixture to a plurality of injection tubes arranged in a grid pattern in the furnace;

injecting the sorbent mixture into the furnace flue gas flow through the plurality of injection tubes; and heating the sorbent mixture with each injection tube with steam before the sorbent mixture is injected into the furnace flue gas flow through the plurality of injection tubes.

8. A method according to claim 7, including the step of heating the sorbent flow by supplying steam around the injection tubes and out of direct contact with the sorbent mixture.

* * * * *